United States Patent [19]

Hipp

[11] Patent Number: 4,469,182

[45] Date of Patent: Sep. 4, 1984

[54] METHOD OF INSTALLING A CASING HANGER

[75] Inventor: James Hipp, New Iberia, La.

[73] Assignee: Petro-Drive, Inc., Lafayette, La.

[21] Appl. No.: 364,526

[22] Filed: Apr. 1, 1982

[51] Int. Cl.[3] ..... E21B 33/03

[52] U.S. Cl. ..... 166/382; 166/96

[58] Field of Search ..... 166/67, 75, 96, 382; 175/220; 52/153, 154, 155, 156, 158; 248/156; 405/224, 227

[56] References Cited

U.S. PATENT DOCUMENTS

| | | | |
|---|---|---|---|
| 2,295,431 | 9/1942 | Shepard et al. | 248/530 |
| 2,826,281 | 3/1958 | Johnson | 52/158 |
| 3,670,507 | 6/1972 | Mott et al. | 405/227 |
| 3,695,351 | 10/1972 | Lubinski | 166/96 |
| 4,218,858 | 8/1980 | Legler | 52/165 |
| 4,279,308 | 7/1981 | Gray et al. | 166/382 |

FOREIGN PATENT DOCUMENTS

| | | | |
|---|---|---|---|
| 45759 | 6/1974 | Australia | 405/227 |
| 4222 | of 1884 | United Kingdom | 52/158 |

*Primary Examiner*—Stephen J. Novosad
*Assistant Examiner*—William P. Neuder
*Attorney, Agent, or Firm*—Bernard A. Reiter

[57] ABSTRACT

A hanger apparatus inserted into the earth and from which the drill casing of a well is hung comprising a central sleeve having a plurality of structural arms extending outwardly therefrom, each terminating in a pile sleeve. A plurality of pipe joints, welded end to end are hammered into the earth through each of the pile sleeves thus "nailing" the central sleeve in fixed position in the earth mass surrounding it. As the pile is driven downwardly through each pile sleeve means it is driven progressively radially outwardly from the central sleeve means so that the piles define a pyramidal mass of earth therewithin that locks the central sleeve still further within the earthen mass. The casing ultimately is affixed, such as by welding, to the central sleeve.

5 Claims, 4 Drawing Figures

METHOD OF INSTALLING A CASING HANGER

BACKGROUND OF THE INVENTION

1. Field of the Invention

This invention pertains to hanger means. More particularly the invention pertains to a hanger apparatus for reliably supporting the casing in an oil or gas well.

2. Statement of the Prior Art

Earlier proposals in this field of invention have concentrated on the object of cementing the well casing in a fixed position in the earth around it. Representative patents are listed as follows:

| Patentee | U.S. Pat. No. | Issue Date |
|---|---|---|
| Glass | 4,269,010 | May 26, 1981 |
| Legler | 4,218,858 | August 26, 1980 |
| Damstra | 2,503,548 | April 11, 1950 |
| Cote | 2,039,779 | May 5, 1936 |
| Nelson | 3,342,444 | September 19, 1967 |
| Shepard | 2,295,431 | September 8, 1942 |
| Self | 897,417 | September 1, 1908 |
| Tardie | 2,638,321 | May 12, 1953 |

SUMMARY OF THE INVENTION

The installation and reliable positioning of a downhole casing, such as for example a casing in an oil well, is an important and necessary step in the preparation for drilling operations. The reliable replacement of the casing becomes somewhat of a problem in the drilling of deeper wells, particularly drilling at greater depths is becoming increasingly necessary as shallower reserves are being depleted. As the wells get deeper, temperature differentials are more prevalent due to higher temperatures at the greater depths and as a result the casing expands, particularly at the upper end which may be pushed upwardly due to heat expansion. Since it is common to cement in these casings into the earth, a state of compression occurs in the casing as it expands. Such expansion and consequence compression results in a "working" of the casing which may in turn cause it to loosen from the cement, and a possible result is that it may come loose and simply fall into the well, thus causing significant damage and financial loss. With a view toward allowing this expansion to naturally occur without producing the aforedescribed compression in the casing, the invention herein disclosed provides an efficient and highly reliable casing hanger apparatus and method, wherein the casing is not locked by placement in the earth and can thus freely expand. It not only accomplishes this aforedescribed solution to a growing basic problem particularly inherent in deep well drilling, but clearly eliminates possibility of the highly damaging occurrence of a lost casing.

The present invention employs a casing hanger which is pinned into the earth in such a manner as to actually support the entire casing from the top thereof. Thus, if any expansion due to heat takes place, such as in deeper wells, the casing itself is free to expand and faces no fixed constraints at its upper end, such as is present in conventional cemented or fixed casings.

The casing hanger apparatus of the invention thus comprises a central sleeve means and from which the entire casing is hung. Extending outwardly from the central sleeve means is a plurality of structural arms, each of which terminates in a pile sleeve means and through which the piles are hammered into the earth so as to pin the entire hanger apparatus into a fixed position within the earth.

Therefore, a principal feature and advantage of the invention resides in a new and improved casing hanger apparatus.

Another feature and advantage of the invention resides in an improved casing hanger apparatus in which the casing is supported at its upper end from the hanger apparatus.

Another feature and advantage of the invention resides in the design of a casing hanger apparatus in which the casing that is hung therefrom is allowed to freely expand, without restriction, upon development of heat in the well being drilled.

Still another feature and advantage of the invention resides in a casing hanger design with obviates the possibility of loss of a casing into the well as a consequence of expansion-contraction which loosens the casing.

Still another feature and advantage of the invention resides in the substantial elimination of the procedure for cementing the upper end of the casing in the ground.

A still further feature and advantage of the invention resides in a new and improved hanger apparatus which distributes the weight of the casing over a substantial ground area.

Yet another feature and advantage of the invention resides in a new casing hanger apparatus with a variable predetermined load ability to support large or small casing loads.

Still another feature and advantage of the invention resides in a new casing hanger apparatus from which the casing for an oil or gas well is hung and in which the casing hanger apparatus is precluded from substantial movement, vertically and/or horizontally while securing the casing in freely positioned downwardly hanging position from the surface.

A still further feature and advantage of the invention resides in a method for installing a casing hanger.

Another feature and advantage of the invention resides in a method for installing a casing hanger and in which the hanger is pinned into the earth by a plurality of pile means.

Numerous other feature and advantages of the invention will become apparent to those skilled in the art upon a careful reading of the following detailed description, claims and drawings, wherein like numerals denote like parts in the several views, and wherein:

DESCRIPTION OF THE PREFERRED EMBODIMENT

Figure 1:
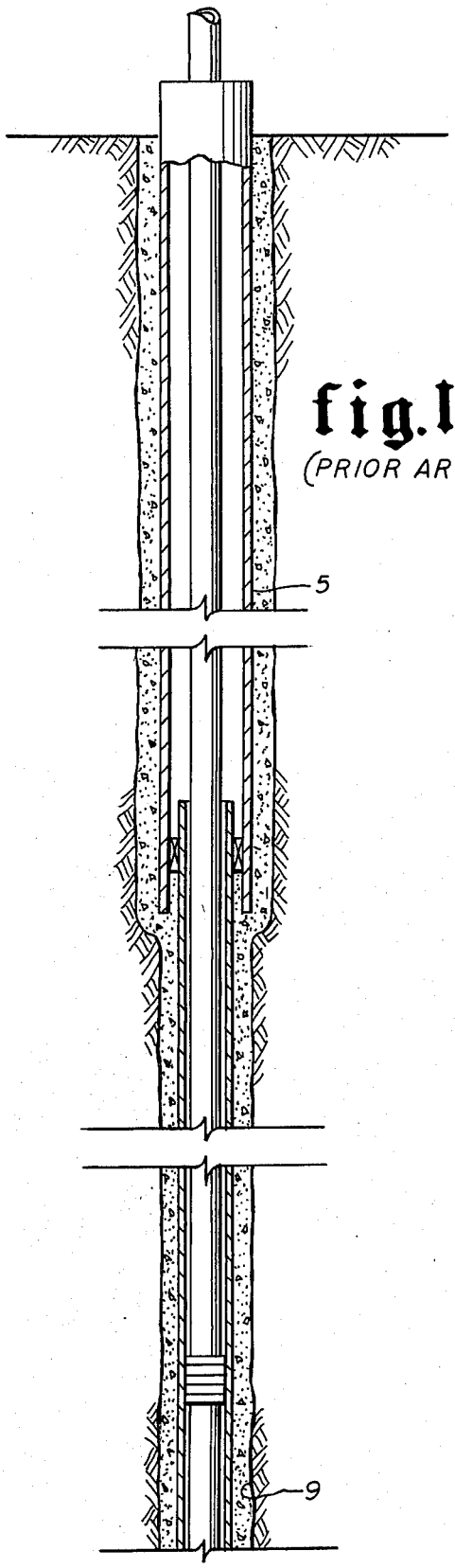
fig.1 (PRIOR ART)
FIG. 1 illustrates the conventional manner in which the casing for an oil or gas well is installed.
Figure 2:
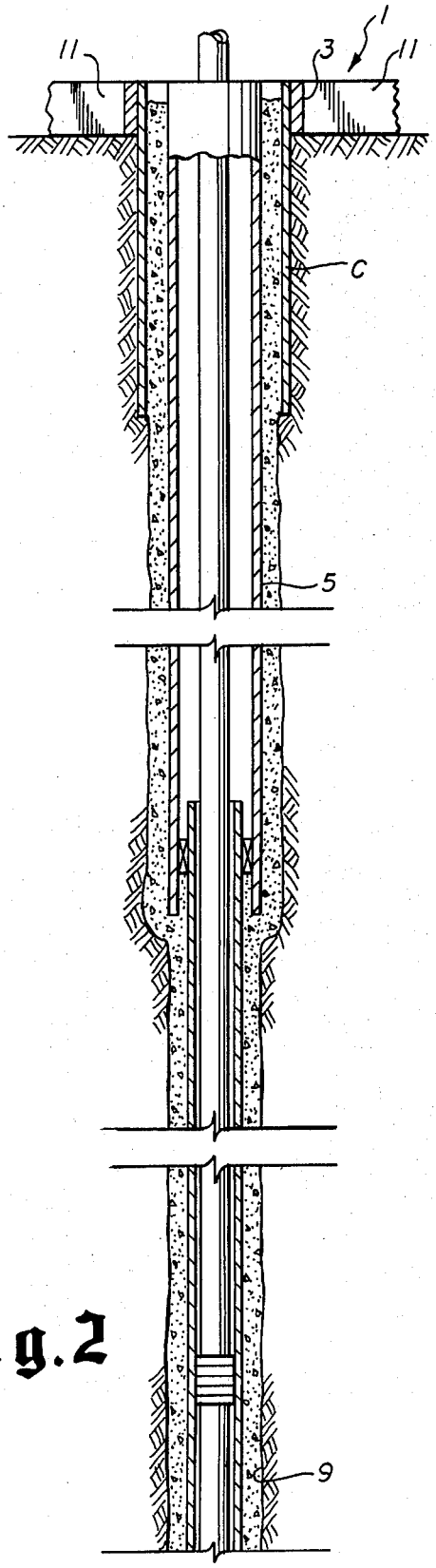
FIG. 2 illustrates the manner in which the casing for an oil or gas well is installed and supported in accordance with the invention.

Briefly, there is shown in FIG. 1 the conventional and known manner for installing and supporting the casing for an oil or gas well. Commonly, the casing "C" is placed in position as the well hole is drilled into the earth. This casing is cemented as illustrated, into position in order to fix the casing position and thus maintain the integrity of the walls of the well. It may readily be visualized that as the depth of the well increases, the magnitude of the weight of the casing becomes greater until it is not uncommon that there may be hundreds of thousands of pounds of steel casing disposed and supported within the well. In accordance with the invention, and as shown in FIG. 2, there is proposed a new concept for installing and supporting the casing within the well whereby the casing is not cemented to the wall of the well, but instead is hung from a hanger supported in the earth proximate the surface of the well. Because of the large weight commonly characterizing a casing, particularly long casings that are installed in deep wells, it is necessary to distribute the casing weight over a large earth area and mass. In pursuit of this purpose, there is devised the casing hanger apparatus means 1 of the invention, see FIGS. 2 through 4. The casing hanger apparatus means 1 comprises a central sleeve means 3 adapted to receive the conductor casing 5 therethrough. The conductor casing consists of a plurality of casing of pipe which are sequentially welded end to end at the top 7 of casing 5 and which thereafter is allowed to descend into the well 9. Each joint of pipe of casing is affixed to the top 7 of each preceding joint.

Figure 3:
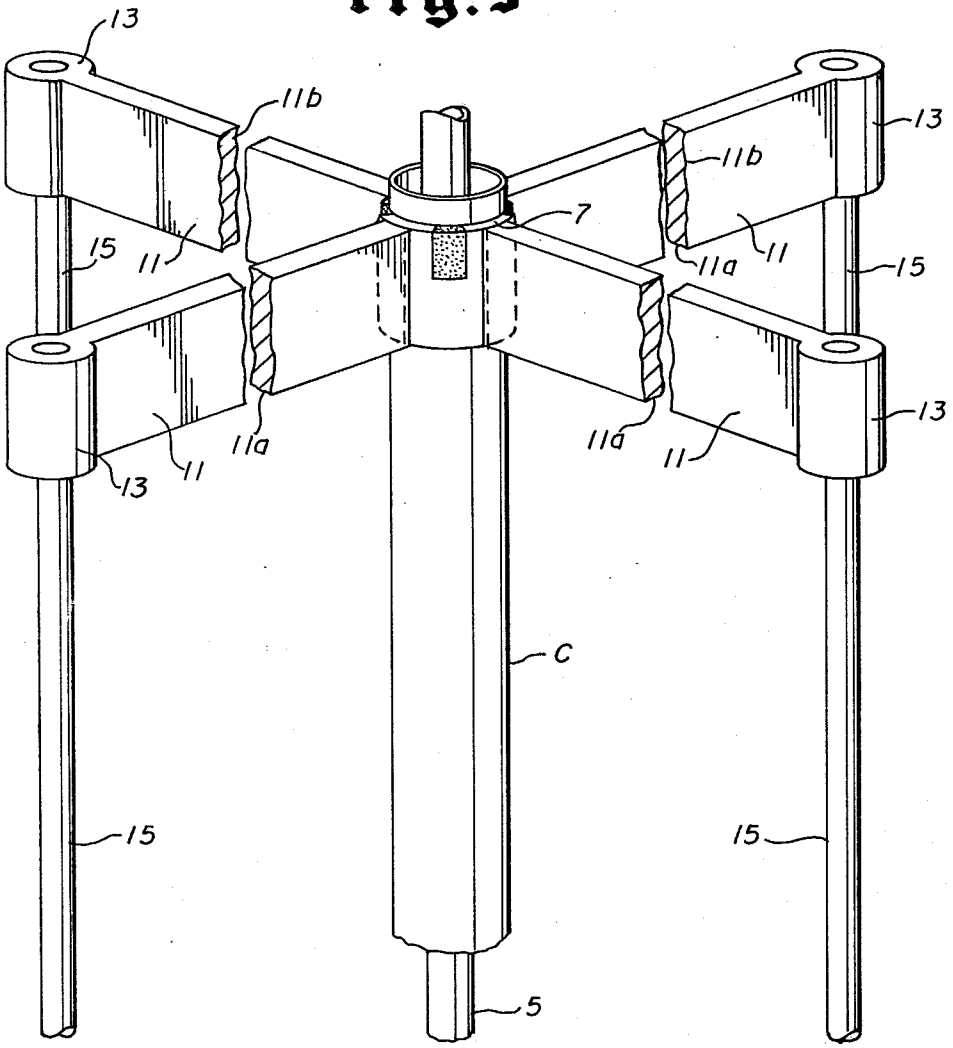
FIG. 3 is an isometric illustration of the casing hanger apparatus of FIG. 2.

Emanating radially from the central sleeve means 3 is a plurality of structural arms 11 which, for exemplary purposes, are shown in FIG. 3 to consist of four radially extending generally equally angularly disposed beam like members and whose dimensional characteristics may be in the range of from five feet to twenty-five feet, more or less. It will be recognized, however, that depending upon the magnitude of weight of the casing to be supported, the structural arms 11 may be larger or greater, as is necessary to securely pin the casing hanger apparatus means 1 in its locked position in the earth. Integrally attached to the remote end of the structural arms 11 is sleeve means 13, each of which is adapted to receive a pile 15. Each pile 15 is installed by a pile driving hammer or the like and may be of variable length, this again depending upon the magnitude of the casing weight to be supported, characteristics of the soil in which the pinning takes place, and other factors, known to affect the stability of the casing hanger apparatus means 1 and the casing 5 which is hung therefrom. It will be readily visualized that the undersides 11*a* of structural arms 11 and the sides 11*b* thereof produce massive resistive surfaces against downward movement of the casing hanger apparatus means 1 which might otherwise occur when the weight of casing 5 is ultimately allowed to rest upon the hanger apparatus means. Similarly, there would be virtually no opportunity for the casing hanger apparatus means 1 to move upwardly, because the piles 15 have been driven into the earth so as to pin the entire structure into its fixed position. It is thus apparent that the piles 15 act to pin the casing hanger apparatus means 1 and hence the casing in such a manner as to preclude any downward movement thereof.

Figure 4:
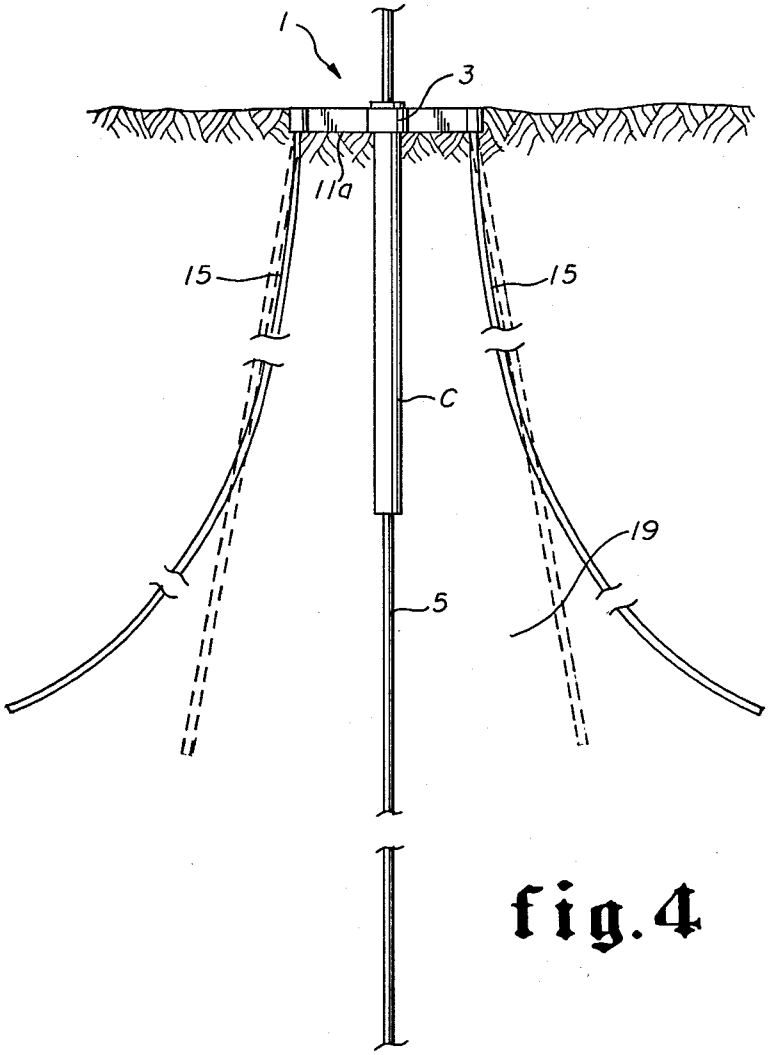
FIG. 4 is a schematic illustration showing the casing hanger apparatus of the invention with piles driven to depth.

With reference now to FIG. 4, there is shown in schematic form a casing hanger apparatus means 1 installed in accordance with the invention. The casing hanger apparatus means 1 has been located and positioned at or near the surface of the earth or on an offshore platform above the surface of a body of water. Such installation is accomplished by driving the piles 15 through each of the pile sleeve means 13 affixed at the terminal end of the structural arms 11. The piles 15 are driven into position with a pile driving rig or the like and may be driven to a depth of one hundred fifty feet or more, this depending upon soil conditions, the weight of the ultimate casing, and other factors, as indicated hereinabove. In founding a casing hanger apparatus means 1 on a platform, barge or the like, the radial distance of structural arms 11 may not be substantial and as a consequence there may be insufficient bearing weight provided by the surrounding earth mass to support the casing. In such event, it is proposed that the piles 15 be driven substantially vertically downward and, at an established depth, outwardly as shown in FIG. 4, so as to thereby enhance the earth resistance to vertical movement of the hanger means 1 by reason of the slope of piles 15. Similarly, it may simply be advisable to drive the piles 15 at a predetermined slant and direction initially. The former alternative, that is of driving the piles vertically downwardly to a predetermined depth before driving them angularly outwardly from the vertical, may be accomplished in a variety of ways, such as, for example, as that disclosed in our co-pending application Ser. No. 35,635, U.S. Pat. No. 4,258,800. Once the hanger is installed, a joint of casing 5 is sequentially welded to the top 7 of preceding joints (FIG. 3) and allowed then to descend into the well while the entire casing is supported from a drill rig hook or the like. In all cases, it will be readily recognized that a principal feature provided by the configuration of piles 15 in conjunction with the casing hanger apparatus means 1 provides for an earthen mass substantially is of pyramidal configuration. This pyramidal mass of 19 is created beneath the surface and essentially constitutes a man made construction that supports the casing 5 from the apex thereof. The pyramidal mass of earth 19, defined by the plurality of piles 15 and the casing hanger apparatus means 1 can, by reason of its configuration, prevent movement neither upwardly nor downwardly. It cannot move upwardly because the mass of earth around it and above it precludes any such movement. Similarly, the mass of earth beneath it precludes any downward movement. Substantial supporting forces bear against the sides 11*b* and undersides 11*a* of arms 11 and against piles 15. As a result, when the casing 5 is ultimately unloaded from the crane or drill rig hook upon the casing hanger apparatus means 1, and securely welded or otherwise affixed in place, it is inherently fixed in a hanging state in which it can expand freely downwardly as a consequence of heat generated deep within the well, but cannot destabilize itself from its relative position within the well. It is, of course, the intention of the inventor hereof that the ambit of the present invention shall cover obvious modifications of the embodiment shown and described herein, provided that such modifications fall within the spirit and scope of the claims appended hereto.

Therefore, that which is claimed and desired to be secured by U.S. Letters Patent is:

1. The method for installing and supporting a casing-liner within a hole bored downwardly into the earth in pursuit of petroleum product therein while providing for free expansion-contraction of the casing-liner while it resides in reliable static position, comprising the steps of:

(a) positioning a casing hanger apparatus means having a plurality of pile sleeve means extending outwardly therefrom over hole into which the casing is to be set;

(b) inserting pile members into each said pile sleeve means;

(c) driving each said pile members to a predetermined depth within the earth so as to fixedly and securely pin the casing hanger apparatus means in its position over the hole while providing a stable and secure support for the casing-liner to be supported therefrom;

(d) inserting sequential length of casing-liner into the hole and affixing each to the other as they are lowered thereinto until the desired depth of lining therefor is achieved;

(e) affixing the casing-liner to the casing hanger apparatus means while said sequential lengths of casing-liner are affixed to each another so that the former hangs in tension state while the load therefrom is distributed by the latter into the earth mass area by said driven pile members.

2. The method of claim 1 wherein said pile members are driven at an angle outwardly and away from the hole so as to enhance the weight holding ability of the hanger apparatus means against the downwardly directed forces produced by the casing-liner hanging therefrom.

3. The method of claim 1 including the additional step of driving said pile members substantially vertically downwardly and subsequently outwardly to both enhance the stability of the casing hanger apparatus means while minimizing potential interfering contact between said pile members and the casing or with one another.

4. The method of claim 3 including the additional step of articulating one or more of the pile members to direct it outwardly after having been driven vertically downwardly.

5. The method of installing a casing-liner and supporting it in a hole that has been excavated from the earth so as to maintain the physical integrity of the hole itself, comprising the steps of:

(a) disposing a casing hanger apparatus means having an opening therethrough above the hole and with the opening in alignment therewith, and characterized by openings for receiving a pile means;

(b) installing pile means through said casing hanger apparatus means and into the earth in an outwardly direction away from the hole for pinning the casing hanger apparatus means in a position and so as to define a pyramidal mass of earth which assists in supporting the casing-liner to be hung within the hole from the casing hanger apparatus means.

(c) inserting sequential length of casing joint into the hole and affixing each to the other as they are lowered thereinto until the desired depth of lining therefor is achieved;

(d) affixing the casing liner to the casing hanger apparatus means while said sequential lengths of casing-liner are affixed to each other so that the former hangs in a tension state while the load therefrom is distributed by the latter throughout the length of the entire casing.

* * * * *